United States Patent [19]

Laemmle et al.

[11] Patent Number: 4,602,670

[45] Date of Patent: Jul. 29, 1986

[54] LUBRICATING PROCESS

[75] Inventors: Joseph T. Laemmle; Mei-Yuan Tsai; John E. Jacoby, all of Murrysville, Pa.

[73] Assignee: Aluminum Company of America, Pittsburgh, Pa.

[21] Appl. No.: 679,134

[22] Filed: Dec. 6, 1984

[51] Int. Cl.[4] ..... B22D 11/07; B22C 3/00

[52] U.S. Cl. ..... 164/472; 164/138; 427/135; 106/38.22

[58] Field of Search ..... 164/72, 121, 138, 472; 427/133, 134, 135; 106/38.22

[56] References Cited

U.S. PATENT DOCUMENTS

| | | | |
|---|---|---|---|
| 3,034,186 | 5/1982 | Holshouser | 22/200.1 |
| 3,253,932 | 5/1966 | White et al. | 106/38.22 |
| 3,381,741 | 5/1968 | Gardner | 164/73 |
| 3,503,770 | 3/1970 | Guillet et al. | 106/270 |
| 3,524,751 | 8/1970 | Smith | 117/5.1 |
| 3,620,290 | 11/1971 | Kress et al. | 164/472 |
| 3,763,244 | 10/1973 | Shubkin | 260/676 R |
| 4,157,728 | 6/1979 | Mitamura et al. | 164/4 |
| 4,265,663 | 5/1981 | Gilicinski et al. | 106/10 |
| 4,282,392 | 8/1981 | Cupples et al. | 585/10 |
| 4,462,948 | 7/1984 | McClain | 264/140 |
| 4,522,250 | 6/1985 | Laemmle et al. | 164/472 |

FOREIGN PATENT DOCUMENTS

| | | | |
|---|---|---|---|
| 925070 | 4/1970 | Canada | 253/128 |
| 2129345A | 5/1984 | United Kingdom . | |

*Primary Examiner*—Nicholas P. Godici
*Assistant Examiner*—Richard K. Seidel
*Attorney, Agent, or Firm*—Douglas G. Glantz

[57] ABSTRACT

A lubricating process is disclosed for continuously casting molten metal through a mold or header including applying a parting lubricant containing alpha-olefin oligomer to the mold or header. In one aspect, the process includes applying a parting lubricant containing alpha-olefin oligomer and fatty ester.

18 Claims, No Drawings

LUBRICATING PROCESS

BACKGROUND OF THE INVENTION

This invention relates to the continuous casting of molten metal in a mold.

A continuous casting process transforms molten metal into ingot for subsequent working such as by rolling or extrusion forming. The continuous casting process takes molten metal and pours it into contact with a mold which typically is water-cooled to extract heat from the molten metal through the wall of the mold. In this way, the outer part of the molten metal cools and solidifies into a shell, the shell further cooling and forming as it withdraws from the mold to form a solid, continuously formed ingot.

Metal casting processes in general have always required a lubricant for separating cast metal from a mold surface. Lard oil was commonly used as a mold lubricant for aluminum ingot casting until the mid-1950s. The lard oil was applied to molds by brushing or swabbing prior to the casting operation. Lard oil had the principal disadvantage of hardening to a highly viscous, grease-like consistency at approximately 40° F. This grease-like form interfered with continuous casting methods where free-flowing lubricant is required. Further, the grease-like lard oil would build up on molds and interfere with ingot cooling.

As continuous casting became the accepted method for forming ingot, castor oil replaced lard oil as the most commonly used mold lubricant. Castor oil is obtained from pressing seeds of the castor plant. Typically, castor oil contains a predominant amount of the triglyceride of ricinoleic acid (12-hydroxyoleic acid). The remaining portion of the castor oil comprises mixed triglycerides of oleic, linoleic, and stearic acids. Castor oil thus falls in a chemical classification known as fatty oils. These materials, as a class, are practically insoluble in water and dissolve freely in organic solvents. The double bonds in hydroxyl groupings in castor oil produce many kinds of chemical reactions to form a wide variety of compounds.

Castor oil does not have the grease-like consistency of lard oil at just below room temperature. However, castor oil is very viscous and difficult to apply to molds in a uniform fashion, especially in cold weather operation. Castor oil undergoes polymerization under casting conditions and produces a varnish-like film on the mold and the ingot. This varnish-like film produces tears and unsatisfactory surface characteristics in the ingot. Further, in direct chill casting by water, castor oil does not separate from the cooling water easily to avoid contamination of the discharged water.

The disadvantages of castor oil used as a mold lubricant in continuous casting have encouraged the search for a replacement mold lubricant.

Smith et al., U.S. Pat. No. 3,524,751, discloses an aluminum ingot casting lubricant of 60%–80% castor oil and 40%–20% of an alkyl ester of an acetylated hydroxy fatty acid. The sole Example in Smith et al. mixes 75% castor oil and 25% n-butyl acetyl ricinoleate.

Gardner et al., Canadian Pat. No. 925,070, discloses a mold lubricant of polybutene alone and mixtures of polybutene in a predominant amount with vegetable oil, animal oil, or mineral oil.

It is an object of the present invention to provide a lubricating process for continuously casting molten metals.

It is another object of the present invention to provide a mold lubricating process which performs efficiently at reduced flow rates of lubricant over the mold.

It is a further object of the present invention to provide a mold lubricating process for casting aluminum and aluminum alloy.

SUMMARY OF THE INVENTION

The present invention provides a lubricating process for continuously casting molten metal in a mold including applying alpha-olefin oligomer as a mold lubricant. The alpha-olefin oligomer can be used alone or as a blend with another organic compound lubricant, e.g., such as including a triglyceride lubricant.

DETAILED DESCRIPTION

It has been found that molten metal can be continuously cast in a mold to produce ingot having preferred surface characteristics. The process of the present invention includes applying a mold lubricant containing alpha-olefin oligomer to the mold.

Alpha-olefin oligomers also are known as isoparaffinic oligomers or polyalphaolefins, and they are classified among the synthetic lubricants. Synthetic lubricants are not new. The first synthetic hydrocarbon oils were produced as early as 1877. Research concentrated on synthetic lubricants in the late 1930s and early 1940s. The second World War pointed out the inadequacies of petroleum lubricants in severe cold weather climates where mineral oil products gelled at extreme low temperatures, preventing aircraft, tanks, and other vehicles from starting. With this critical need in mind, ester lubricants were developed by German research. In 1947 the English began using ester lubricants in turboprop aircraft where mineral oil lubricants could not perform satisfactorily in high temperatures. Twelve major synthetic lubricant base stocks include cycloaliphatics, dialkylbenzene, diesters, halogenated products, phosphate esters, polyalkylene glycols, polyalphaolefins (alpha-olefin oligomers), polybutenes, polyolesters, polyphenol ethers, silicate esters, and silicate fluids. The synthetic lubricants have higher viscosity indices (VI) than mineral oil-base stock. A high VI means less change (decrease) of viscosity at higher temperatures. For this reason, the synthetic lubricants are suitable additives for crank case applications in automobiles.

Alpha-olefin oligomer is a synthesized hydrocarbon which essentially has a starting material of ethylene derived from natural gas. The synthetic fatty acids are derived from alpha olefins. Alpha-olefin oligomer is formed by polymerization or, more specifically, oligomerization. The following sequence of carefully controlled chemical reactions represents the formation of one class of alpha-olefin oligomer.

Alpha-olefin Preparation $$CH_2{=}CH_2 \xrightarrow{\text{Catalyst}} CH_3CH_2{-}(CH_2CH_2)_3CH{=}CH_2$$

Ethylene — 2 Carbon Atoms; Decene-1 — 10 Carbon Atoms

Oligomerization

-continued

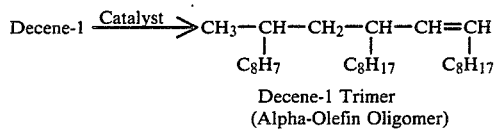

Decene-1 Trimer
(Alpha-Olefin Oligomer)

Hydrogenation

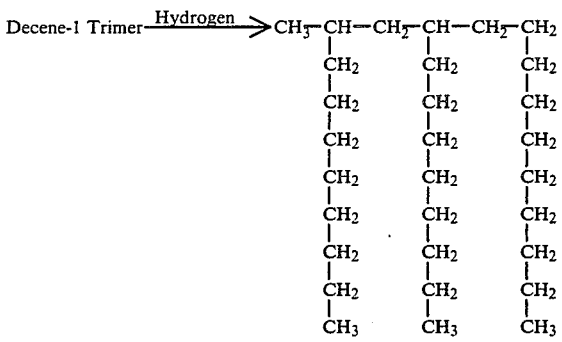

Saturated

Ethylene is polymerized to from an alpha-olefin. The alpha-olefin in this example, 1-decene, undergoes oligomerization to form a trimer (the alpha-olefin oligomer) from three monomer units. Decene-1 trimer is used here for illustration purposes only, and the present invention includes alpha-olefin oligomers having three to ten monomer units, the monomer unit having 6–16 carbon atoms per molecule. Alpha-olefin oligomers are available commercially from Gulf Oil Company as Synfluid, i.e., under the trade name Synfluid, from Bray Oil Company as PAOL, from Mobil as Mobil SHF, from Emery Industries as Poly-x-olefin, and from Ethyl Corporation.

The oligomer preferably then may be saturated.

The present invention includes applying alpha-olefin oligomer as a mold lubricant. The mold lubricant can be used alone or blended with one or more lubricants such as fatty esters including the triglycerides, e.g., castor oil or glycerol trioleate. The process of the present invention includes casting the molten metal, such as aluminum, in a mold and applying a lubricant blend to the mold, the blend containing fatty ester lubricant, e.g., such as triglyceride, or fatty alcohol lubricant, e.g., such as oleyl alcohol, and at least about 0.5% by weight alpha-olefin oligomer. A more preferred range of triglyceride content includes about 10%–95% by weight and more preferably 10–50% by weight. Triglyceride blended into the lubricant reduces the content of the more expensive alpha-olefin oligomer.

The lubricating process of this invention has been used with efficient results in the continuous casting of aluminum and aluminum alloys. It has been found that the flow rate of mold lubricant can be reduced significantly.

The mold lubricant of the present invention containing alpha-olefin oligomer has a viscosity in the range of about 1 cs to 3 cs at 450° F. The composition's viscosity at 450° F. is determined by the method published in ASTM D445. Below about 1 cs at 450° F., surface defects and tearing occur on the ingot surface. Above about 3 cs, heat transfer from the molten metal to the mold is reduced, and bleedouts appear on the ingot surface.

The lubricant in one embodiment contains an oxidation inhibitor such as 2,6-di-tert-butyl paracresol. The lubricant applied in accordance with the present invention also can contain an effective concentration of a biocide.

While the invention has been described in terms of preferred embodiments, the claims appended hereto are intended to encompass other embodiments which fall within the spirit of the invention.

What is claimed is:

1. A continuous casting process wherein molten metal is cast into a cooled, lubricated mold, said process comprising the steps of:

(a) lubricating the mold by applying a parting lubricant containing alpha-olefin oligomer to the mold, and (b) casting molten aluminum or aluminum alloy to form a continuous ingot.

2. A process as set forth in claim 1 wherein said parting lubricant further comprises another organic compound lubricant.

3. A process as set forth in claim 2 wherein said organic compound lubricant comprises fatty ester.

4. A process as set forth in claim 2 wherein said organic compound lubricant comprises fatty alcohol.

5. A process as set forth in claim 1 wherein said parting lubricant has a viscosity in the range of about 1 to 3 cs at 450° F.

6. A process as set forth in claim 5 wherein said alpha-olefin oligomer comprises a blend of two or more oligomers.

7. A process as set forth in claim 6 wherein said blend of oligomers comprises oligomers having three to ten monomer units.

8. A process as set forth in claim 7 wherein said continuous casting comprises direct chill casting.

9. A process as set forth in claim 8 wherein said lubricant contains triglyceride.

10. A continuous casting process wherein molten metal is cast into a cooled, lubricated mold, said process comprising the steps of:

(a) lubricating the mold by applying a parting lubricant comprising a lubricant blend containing fatty ester lubricant and at least about 50% by weight alpha-olefin oligomer, and (b) casting molten aluminum or aluminum alloy to form a continuous ingot.

11. A process as set forth in claim 1 wherein said lubricant blend contains about 10%–50% by weight triglyceride.

12. A process as set forth in claim 11 wherein said triglyceride comprises castor oil.

13. A process as set forth in claim 11 wherein said triglyceride comprises glycerol trioleate.

14. A process as set forth in claim 13 wherein said lubricant blend further comprises a biocide.

15. A process as set forth in claim 13 wherein said lubricant blend further comprises an oxidation inhibitor.

16. A process as set forth in claim 15 wherein said inhibitor comprises 2,6-di-tert-butyl paracresol.

17. A continuous casting process for casting molten aluminum or aluminum alloy to form a continuously formed ingot in a cooled, lubricated mold, the improvement comprising applying alpha-olefin oligomer as a parting lubricant to the mold or header.

18. A process as set forth in claim 17 wherein said parting lubricant further comprises fatty ester.

* * * * *

UNITED STATES PATENT AND TRADEMARK OFFICE

CERTIFICATE OF CORRECTION

PATENT NO. : 4,602,670

DATED : July 29, 1986

INVENTOR(S) : Joseph T. Laemmle, Mei-Yuan Tsai, John E. Jacoby

It is certified that error appears in the above-identified patent and that said Letters Patent is hereby corrected as shown below:

| | |
|---|---|
| Col. 3, line 4 | Change "$C_8H_7$" to --$C_8H_{17}$-- (first occurrence). |
| Col. 3, line 25 | Change "from" to --form--. |
| Claim 11, Col. 4, line 48 | Change "1" to --10--. |

Signed and Sealed this

Fourteenth Day of October, 1986

[SEAL]

*Attest:*

DONALD J. QUIGG

*Attesting Officer*

*Commissioner of Patents and Trademarks*